US008465018B2

(12) United States Patent
Fujikura et al.

(10) Patent No.: US 8,465,018 B2
(45) Date of Patent: Jun. 18, 2013

(54) AIR BLOWING APPARATUS AND AIR BLOWING METHOD WITH SURFACES HAVING CURVATURES

(75) Inventors: Tatsuo Fujikura, Kanagawa-ken (JP); Yuhei Chiwata, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 266 days.

(21) Appl. No.: 13/006,616

(22) Filed: Jan. 14, 2011

(65) Prior Publication Data

US 2011/0175278 A1 Jul. 21, 2011

(30) Foreign Application Priority Data

Jan. 15, 2010 (JP) ..... 2010-007258

(51) Int. Cl.
*B65H 31/00* (2006.01)
*B65H 29/24* (2006.01)

(52) U.S. Cl.
CPC ..... *B65H 29/246* (2013.01)
USPC ..... 271/211; 271/209; 271/161

(58) Field of Classification Search
USPC ..... 271/211, 209, 161
See application file for complete search history.

(56) References Cited

U.S. PATENT DOCUMENTS 3,279,792 A * 10/1966 Kostal et al. ..... 271/211
3,304,083 A * 2/1967 Rasmussen et al. ..... 271/211
3,761,080 A * 9/1973 Larson ..... 271/209
4,353,542 A * 10/1982 Knight et al. ..... 271/209
4,772,008 A * 9/1988 Spencer et al. ..... 271/188
5,014,972 A * 5/1991 Anderson et al. ..... 271/161
2010/0295240 A1* 11/2010 Brewer et al. ..... 271/220
2011/0181676 A1* 7/2011 Chiwata ..... 271/5
2011/0219641 A1* 9/2011 Fujikura et al. ..... 34/619
2011/0316949 A1* 12/2011 Fujikura et al. ..... 347/102
2011/0316950 A1* 12/2011 Chiwata ..... 347/102
2012/0026263 A1* 2/2012 Chiwata ..... 271/97
2012/0224902 A1* 9/2012 Chiwata ..... 400/578

FOREIGN PATENT DOCUMENTS

JP 9-309624 A 12/1997
JP 10-297813 A 11/1998
JP 2006-248771 A 9/2006
JP 2008-290799 A 12/2008
JP 2008-290800 A 12/2008
JP 2008290799 A * 12/2008

* cited by examiner

*Primary Examiner* — Gerald McClain
(74) *Attorney, Agent, or Firm* — Birch, Stewart, Kolasch & Birch, LLP

(57) ABSTRACT

An air blowing apparatus includes: a paper stack accommodating section which forms a paper stack accommodating space for accommodating a stack of paper; and an air blowing device which blows air toward an edge of each sheet of paper of the stack of paper accommodated in the paper stack accommodating space, wherein the paper stack accommodating section includes a curved surface which faces a paper surface of the stack of paper, and the curved surface extends in an air blowing direction of the air blowing device and has a curvature in a direction perpendicular to the air blowing direction of the air blowing device.

10 Claims, 12 Drawing Sheets

AIR BLOWING APPARATUS AND AIR BLOWING METHOD WITH SURFACES HAVING CURVATURES

BACKGROUND OF THE INVENTION

1. Field of the Invention

The present invention relates to an air blowing apparatus and an air blowing method whereby the amount of moisture can be equalized reliably between sheets of paper and within sheets of paper, even in the case of a stack of paper having a large amount of curl.

2. Description of the Related Art

Paper produces deformation due to expansion and contraction immediately after deposition of ink thereon by a printing apparatus, due to differences in the amount of ink solvent in the image region. Deformation due to expansion and contraction of the paper as a result of variation in the amount of moisture in the paper is especially pronounced in systems which perform printing by depositing aqueous ink onto ordinary paper. Furthermore, in double-side printing, there are disparity in image size and position between the images which are formed on the front surface and the rear surface (front/rear image error), as a result of the deformation due to expansion and contraction of the paper after the deposition of ink for front surface printing and before the deposition of ink for rear surface printing. Therefore, immediately after printing, it is necessary to equalize the amount of moisture between the sheets and within the sheets so as to correct or alleviate expansion, contraction, and deformation of the paper, by passing air from the natural environment through the gaps between the respective sheets of paper.

Japanese Patent Application Publication No. 2008-290800 discloses a composition in which the intermediate portion of a stack of paper is gripped from front and rear sides by a pair of pressing members and air is blown onto end faces of the paper stack.

Japanese Patent Application Publication No. 2006-248771 discloses a composition in which a ridge is formed in a stacking surface that supports paper so as to create a peak shape (inverted V shape), in order to correct curl where the paper is curved with a concave shape toward the upper side.

Japanese Patent Application Publication No. 10-297813 discloses a composition in which a paper stack loading table designed to align paper is formed in a tiltable fashion, and furthermore air blowing ports are formed in an outer perimeter wall which surrounds this paper stack loading table.

In a seasoning apparatus which blows air of the ambient temperature and humidity between sheets of paper, in contrast to a simple paper aligning apparatus or paper handling apparatus, it is necessary to blow air simultaneously and uniformly onto the whole stack of paper. In particular, in seasoning of a stack of paper on which images containing a large amount of ink have been printed, if there is a large amount of curl in the end portions of the stack of paper, then the stack of paper may incline toward one side due to the blowing of air, making it impossible to blow air with respect to each individual sheet of the stack of paper. More specifically, as shown in FIG. 13, if curl occurs which bends in the air blowing direction indicated by the arrow in a paper stack 32, then the air flow is not liable to enter into the gaps between the sheets of paper.

In a composition where the intermediate portion of a paper stack is pressed from the front and rear sides by a pair of pressing members, as in Japanese Patent Application Publication No. 2008-290800, as the curl of the paper stack in the air blowing direction becomes greater, there arises a portion of the paper stack which receives the air flow fully and a portion of the paper stack which hardly receives the air flow, and therefore it is difficult to equalize the amount of moisture in the paper stack, even if paper handling is possible. In a composition where an inverted V-shaped stacking surface having a ridge is used, as described in Japanese Patent Application Publication No. 2006-248771, it is difficult to equalize the amount of moisture in the paper stack, even if curl in a concave shape toward the upper side can be corrected in each individual sheet of paper. Even with a composition which uses a tiltable paper stack loading table as described in Japanese Patent Application Publication No. 10-297813, if there is a large amount of curl of the paper stack in the air blowing direction, then there arises a portion of the paper stack which receives the air flow fully and a portion of the paper stack which hardly receives the air flow, and therefore it is difficult to equalize the amount of moisture in the paper stack.

SUMMARY OF THE INVENTION

The present invention has been contrived in view of these circumstances, an object thereof being to provide an air blowing apparatus and an air blowing method whereby the amount of moisture can be equalized reliably between sheets of paper and within sheets of paper, even in the case of a stack of paper having a large amount of curl.

In order to attain an object described above, one aspect of the present invention is directed to an air blowing apparatus comprising: a paper stack accommodating section which forms a paper stack accommodating space for accommodating a stack of paper; and an air blowing device which blows air toward an edge of each sheet of paper of the stack of paper accommodated in the paper stack accommodating space, wherein the paper stack accommodating section includes a curved surface which faces a paper surface of the stack of paper, and the curved surface extends in an air blowing direction of the air blowing device and has a curvature in a direction perpendicular to the air blowing direction of the air blowing device.

More specifically, since the paper stack accommodating section forming a paper stack accommodating space includes a curved surface which faces a paper surface of the paper stack and the curved surface extends in the air blowing direction of the air blowing device and has a curvature in a direction perpendicular to the air blowing direction of the air blowing device, then even in the case of a stack of paper having a large amount of curl, it is possible to introduce an air flow uniformly into the gaps between the sheets of paper and therefore the amount of moisture can be equalized reliably between the sheets and within each sheet.

According to one mode of the invention, the paper stack accommodating section includes a plurality of curved surfaces which respectively face the paper surfaces of the stack of paper and have a same direction of curve, the paper stack accommodating space being sandwiched between the plurality of curved surfaces.

According to another mode of the invention, the plurality of curved surfaces may have mutually different curvatures. In other words, by adopting different curvatures for the curved surface which faces one paper surface (front surface) of the paper stack and the curved surface which faces the other paper surface (rear surface) of the paper stack, a composition is achieved in which non-uniform behavior of the paper stack is created during air blowing so that uniform passage of air is possible.

According to another mode of the invention, the paper stack accommodating section has a ridge portion that connects with the curved surface, is situated on a paper input side, and is formed in a chamfered shape. In other words, a composition may be achieved in which the paper stack can be introduced readily into the paper stack accommodating space.

According to another mode of the invention, the curvature of the curved surface is substantially same in the air blowing direction. In other words, a composition is achieved in which an air flow can be introduced uniformly into the gaps between the sheets of paper.

According to another mode of the invention, the paper stack accommodating section includes a paper stack loading table on which the stack of paper is mounted, and a ceiling plate disposed to face the paper stack loading table, each of the paper stack loading table and the ceiling plate having the curved surface; and the paper stack accommodating space is formed as a space sandwiched between the curved surface of the paper stack loading table and the curved surface of the ceiling plate.

According to another mode of the invention, the curved surface of the paper stack loading table and curved surface of the ceiling plate are both formed to curve downward in a vertical direction. In this composition, it is easy to introduce into the paper stack accommodating space even the stack of paper that bends downward in the vertical direction due to the gravity.

According to another mode of the invention, the paper stack accommodating section forms the paper stack accommodating space in which the stack of paper can be accommodated in the vertical direction.

According to another mode of the invention, the paper stack accommodating section is capable of adjusting a size of the paper stack accommodating space in accordance with a paper size of the stack of paper.

In order to attain an object described above, another aspect of the present invention is directed to an air blowing method comprising the steps of: accommodating a stack of paper in a paper stack accommodating space sandwiched between a first surface and a second surface opposing the first surface, the first surface extending in a first direction and having a curvature in a second direction perpendicular to the first direction; and blowing air toward an edge of each sheet of paper of the stack of paper in the first direction, by an air blowing device.

According to the present invention, even in the case of a stack of paper having a large amount of curl, it is possible to equalize the amount of moisture reliably between the sheets and within each sheet.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DESCRIPTION OF THE PREFERRED EMBODIMENTS

Figure 1:
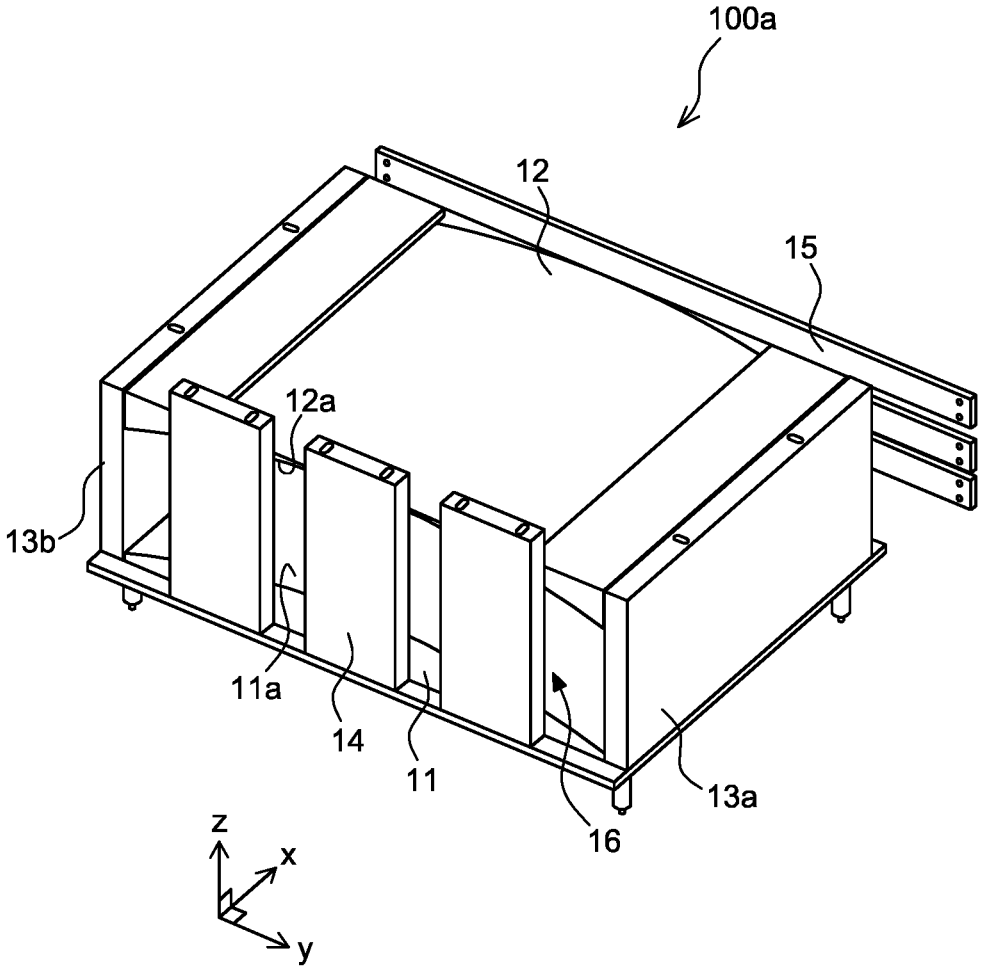
FIG. 1 is a principal perspective diagram of one example of a seasoning apparatus according to a first embodiment of the invention.

FIG. 1 is a principal perspective diagram of a seasoning apparatus 100*a* according to a first embodiment of the present invention being applied. As shown in FIG. 1, a space 16 which accommodates a stack of paper immediately after printing (this space is also called "paper stack accommodating space") is formed by a paper stack loading table 11, a ceiling plate 12, side plates 13*a* and 13*b*, a front plate 14 and a rear plate 15. In other words, the paper accommodating space 16 is a space sandwiched between the paper stack loading table 11 and the ceiling 12, the two side plates 13*a* and 13*b*, and the front plate 14 and the rear plate 15, the members of each of these pairs being arranged to opposite each other.

The upper face 11*a* of the paper stack loading table 11 (which is also referred to as "paper loading surface") and lower face 12*a* of the ceiling plate 12 (which is also referred to as "paper pressing surface") are surfaces which face the paper surfaces (namely, the front surface or rear surface of paper) of the paper stack accommodated inside the paper stack accommodating space 16. The paper loading surface 11*a* and the paper pressing surface 12*a* extend in the x direction (air blowing direction) in FIG. 1, and also have a curvature in the y direction which is perpendicular to the x direction in FIG. 1. Below, the paper loading surface 11*a* and the paper restricting surface 12*a* are also called "curved surfaces". The paper loading surface 11*a* and the paper restricting surface 12*a* according to the present embodiment are both formed so as to curve upward in the vertical direction (the z direction in the drawing). In other words, the paper stack accommodating space 16 according to the present embodiment is formed as a substantially arc-shaped space which is faced on either side by a plurality of curved surfaces 11*a* and 12*a* that curve upwards in the vertical direction.

Figure 2:
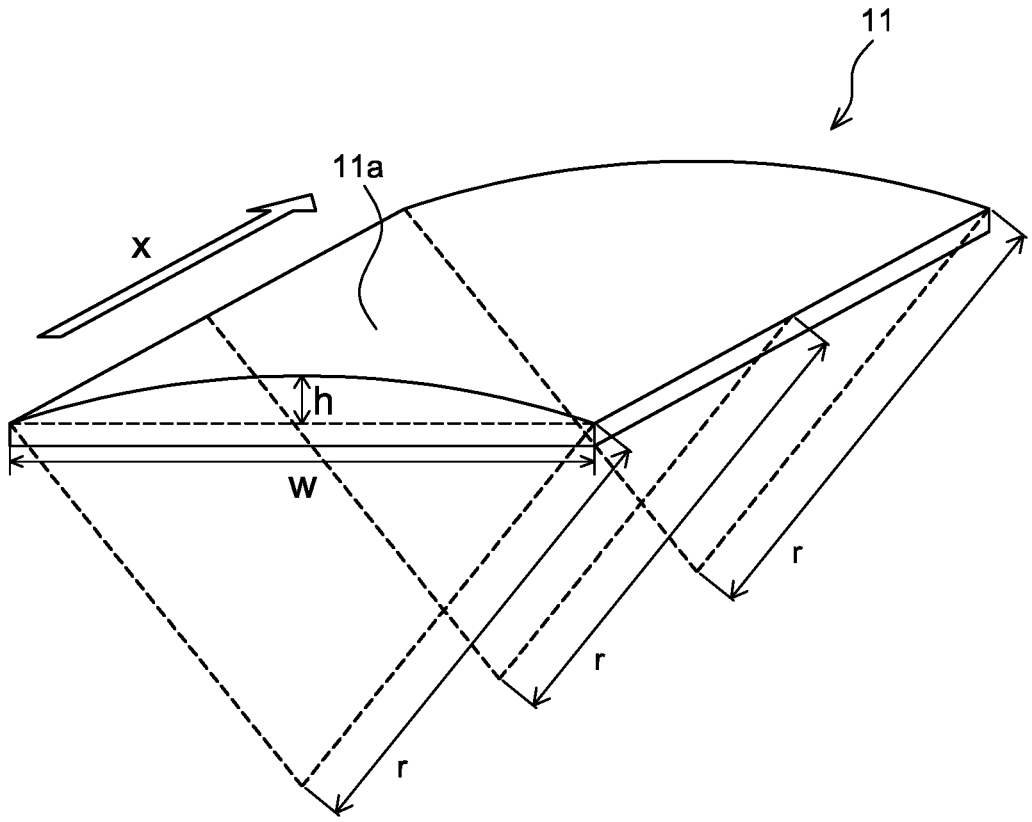
FIG. 2 is a perspective diagram showing one example of a paper stack loading table.

The paper stack loading table 11 in FIG. 1 is shown in the perspective diagram in FIG. 2. In FIG. 2, the curvature (1/r) of the paper loading surface 11*a* is substantially the same throughout the length of the paper in the x direction (air blowing direction). Although not shown in the drawings, the curvature of the paper restricting surface 12*a* of the ceiling plate 12 is also substantially the same in the x direction.

For example, if the width w of the paper stack loading table 11 is taken to be 600 mm, then the height h of the paper loading surface 11*a* is 50 to 60 mm.

Figure 3:
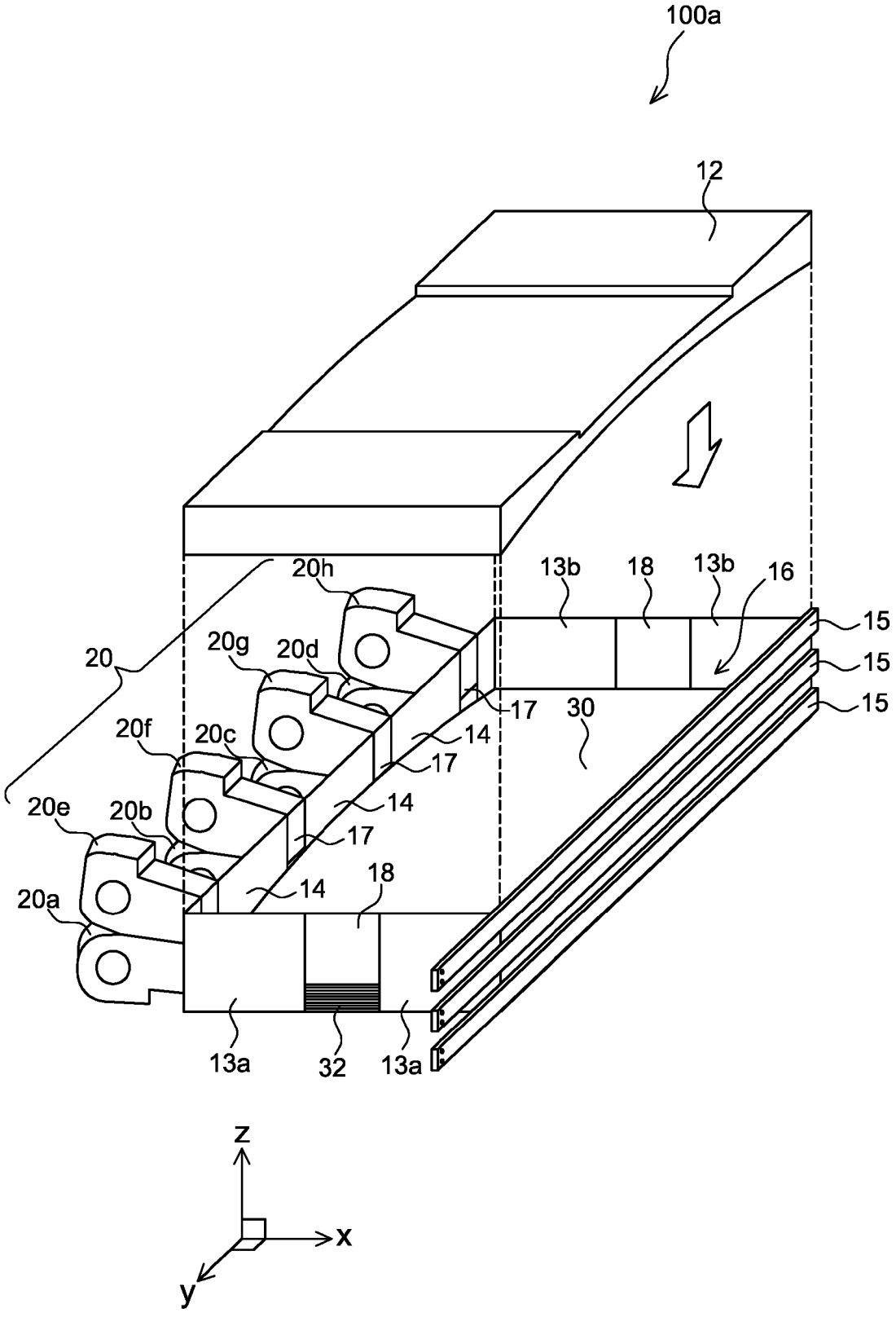
FIG. 3 is a perspective diagram showing one example of air blowing devices disposed about the periphery of a paper stack accommodating space.

FIG. 3 is a perspective diagram showing air blowing devices 20 (20*a* to 20*h*) which are arranged about the periphery of the paper stack accommodating space 16. The air blowing devices 20 in the present embodiment blow an air flow toward the lengthwise direction edges of the respective sheets of paper 30 in the paper stack 32 which is mounted on the paper stack loading table 11 and accommodated in the paper stack accommodating space 16. In other words, the air blowing devices 20 perform blowing of air in terms of the x direction in FIG. 2. In the present embodiment, the air blowing devices 20 are centrifugal fans, but they are not limited in particular and may be axial flow fans. Air blowing ports 17 (opening sections) are formed respectively at the positions of the outlet ports of the respective air blowing devices 20 of the front plate 14. The air blowing ports 17 are formed with an opening length substantially equal to the height of the paper stack accommodating space 16, in such a manner that an air flow can be blown simultaneously onto substantially the whole range of the height direction z of the paper stack accommodating space 16. Furthermore, air passage ports 18 through which the air flow output from the air blowing devices 20 can be expelled are formed in the side plates 13*a* and 13*b*. The ceiling plate 12 suppresses rising up of the paper 30 during air blowing.

Figure 4:
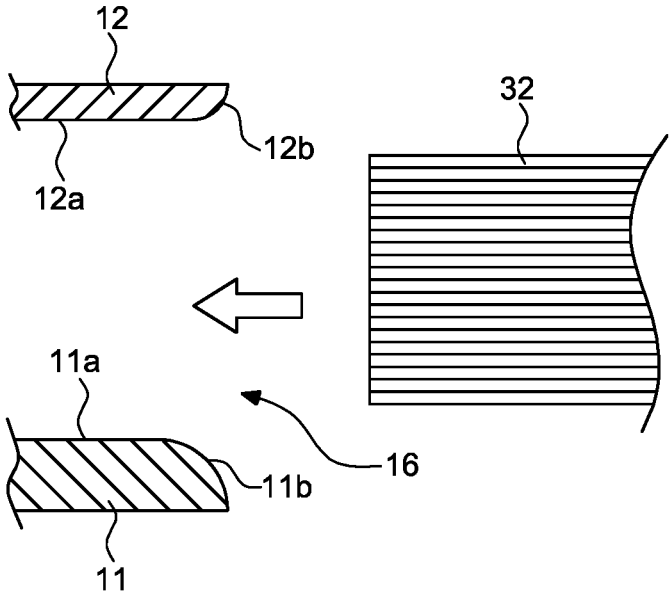
FIG. 4 is a cross-sectional diagram showing a ridge portion on the paper introduction side of a paper stack loading table and a ceiling plate.

Furthermore, as shown in the cross-sectional diagram in FIG. 4, a ridge portion 11*b* on the paper input side of the paper stack loading table 11 and a ridge portion 12*b* on the paper input side of the ceiling plate 12 are formed in a chamfered shape. In other words, introduction of the paper stack 32 into the paper stack accommodating space 16 is made easier by forming a radius shape on the ridge portion 11*b* which connects with (continues into) the paper loading surface 11*a* and the ridge portion 12*b* which connects with the paper restricting surface 12*a*.

An example is described here where a paper stack 32 is introduced into the paper stack accommodating space 16 from the rear side by removing the rear plate 15, but the invention is not limited in particular to a case of this kind. It is also possible to introduce the paper stack into the paper stack accommodating space 16 from the upper side by removing the ceiling plate 12, and it is also possible to adopt a structure in which the ceiling plate 12 opens and closes.

Furthermore, FIG. 1 shows a case where the curvature of the paper loading surface 11*a* and the curvature of the paper restricting surface 12*a* are the same, but the present invention is not limited in particular to a case of this kind. By making the curvature of the paper loading surface 11*a* of the paper stack loading table 11 different from the curvature of the paper restricting surface 12*a* of the ceiling plate 12, it is possible to achieve non-uniform oscillation of the paper 30 of the paper stack 32 during air blowing in such a manner that the seasoning (air blowing) performance is improved.

Figure 13:
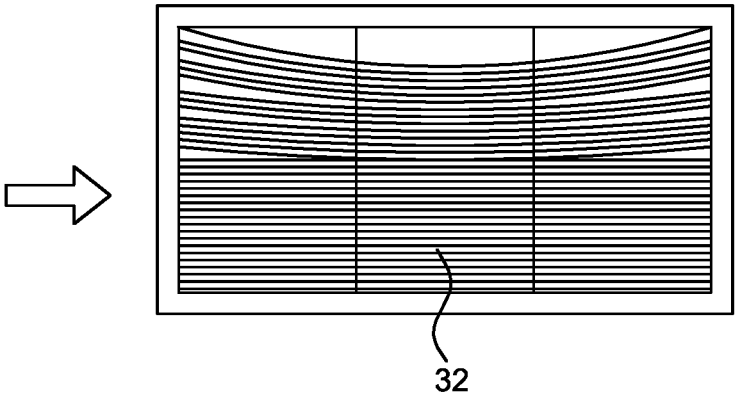
FIG. 13 is an illustrative diagram for describing an issue in cases where a paper stack has curl.

For example, the curvature of the paper loading surface 11*a* is made greater than the curvature of the paper restricting surface 12*a*. By this means, it is possible to blow air uniformly between the sheets of paper 30 even if there is strong curl in the end portions of the paper stack 32 as shown in FIG. 13.

Figure 5:
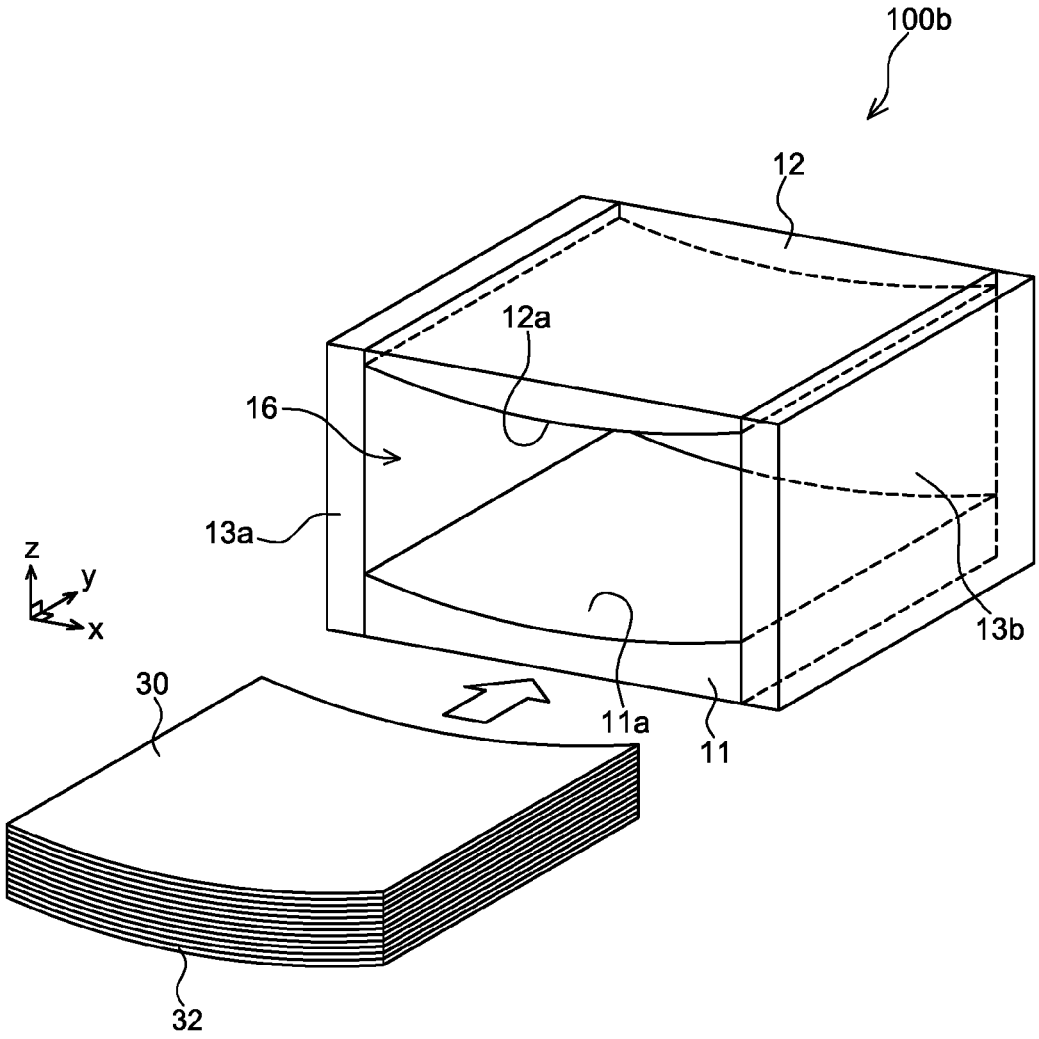
FIG. 5 is a principal perspective diagram of one example of a seasoning apparatus according to a second embodiment of the invention.

FIG. 5 is a principal perspective diagram of a seasoning apparatus 100*b* according to a second embodiment. Constituent elements which are the same as the seasoning apparatus 100*a* according to the first embodiment shown in FIG. 1 are labeled with the same reference numerals and items already described above are not explained further below.

In the present embodiment, the paper loading surface 11*a* of the paper stack loading table 11 and the paper restricting surface 12*a* of the ceiling plate 12 are both formed to curve downward in the vertical direction (the z direction in the drawings). In other words, the paper stack accommodating space 16 according to the present embodiment is formed as a substantially arc-shaped space which are faced on either side by a plurality of curved surfaces 11*a* and 12*a* that curve downwards in the vertical direction. Therefore, even a paper stack 32 which is curved downwards in the vertical direction due to the weight of the paper as shown in FIG. 5 can be introduced readily into the paper stack accommodating space 16.

Figure 6:
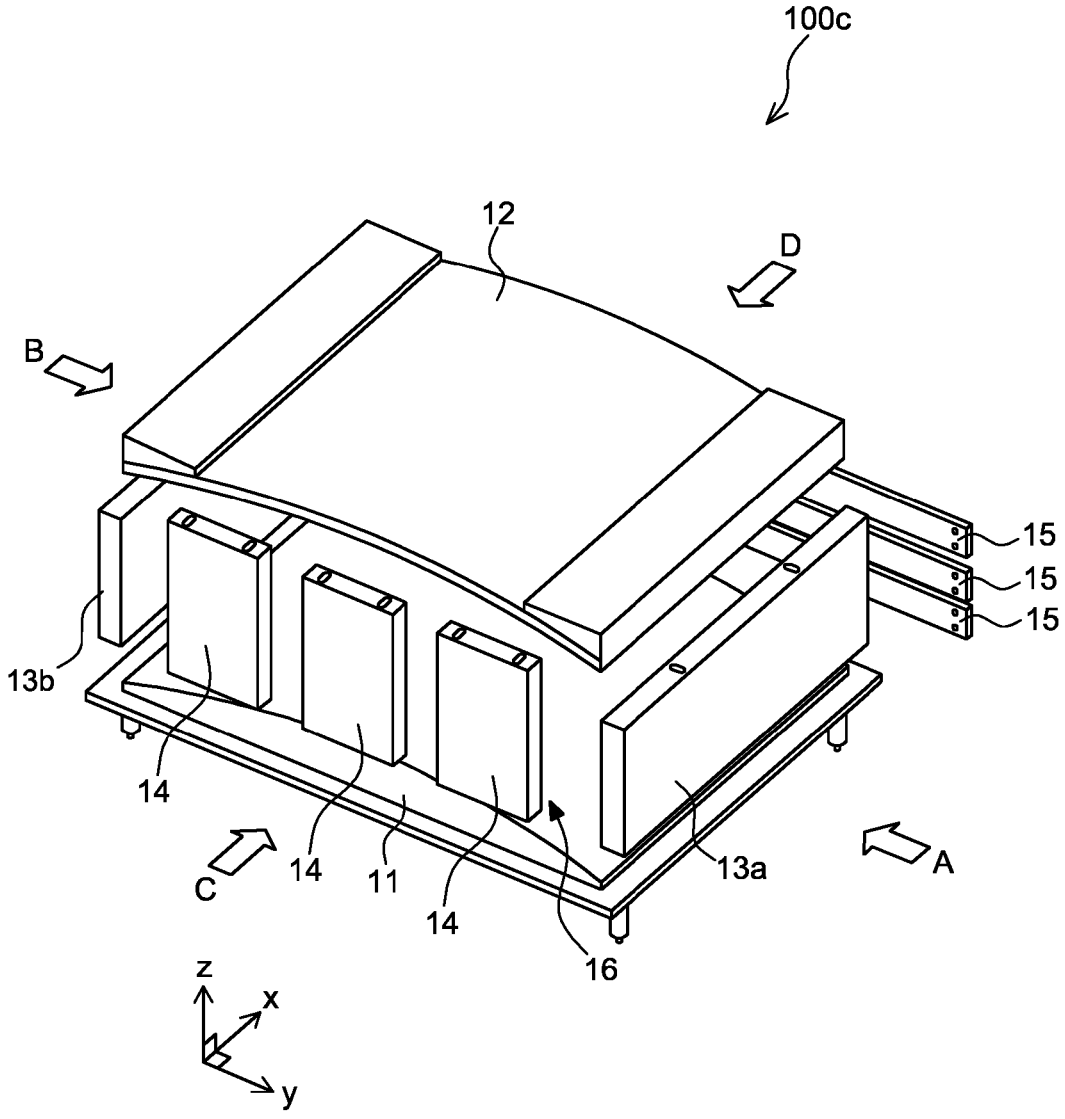
FIG. 6 is a principal perspective diagram of one example of a seasoning apparatus according to a third embodiment of the invention.

FIG. 6 is a principal perspective diagram of a seasoning apparatus 100*c* according to a third embodiment. Constituent elements which are the same as the seasoning apparatus 100*a* according to the first embodiment shown in FIG. 1 are labeled with the same reference numerals and items already described above are not explained further below.

In the present embodiment, the width of the paper stack accommodating space 16 in the x direction and the y direction can be adjusted freely by moving the side plates 13*a*, 13*b*, and the front plate 14 and rear plate 15. In other words, the side plate 13*a* is movable in the direction of arrow A, the side plate 13*b* is movable in the direction of arrow B, the front plate 14 is movable in the direction of arrow C and the rear plate 15 is movable in the direction of arrow D. The drive mechanisms which move the side plates 13*a* and 13*b*, the front plate 14 and the rear plate 15 may employ commonly known drive mechanisms. For example, the plates are driven by motors.

If the size of the paper is limited (for example, to A4 size and A3 size only), it is not necessary to compose all of the side plates 13*a* and 13*b*, the front plate 14 and the rear plate 15 in a movable fashion. For example, a composition may be adopted in which only the rear plate 15 is movable.

Figure 7:
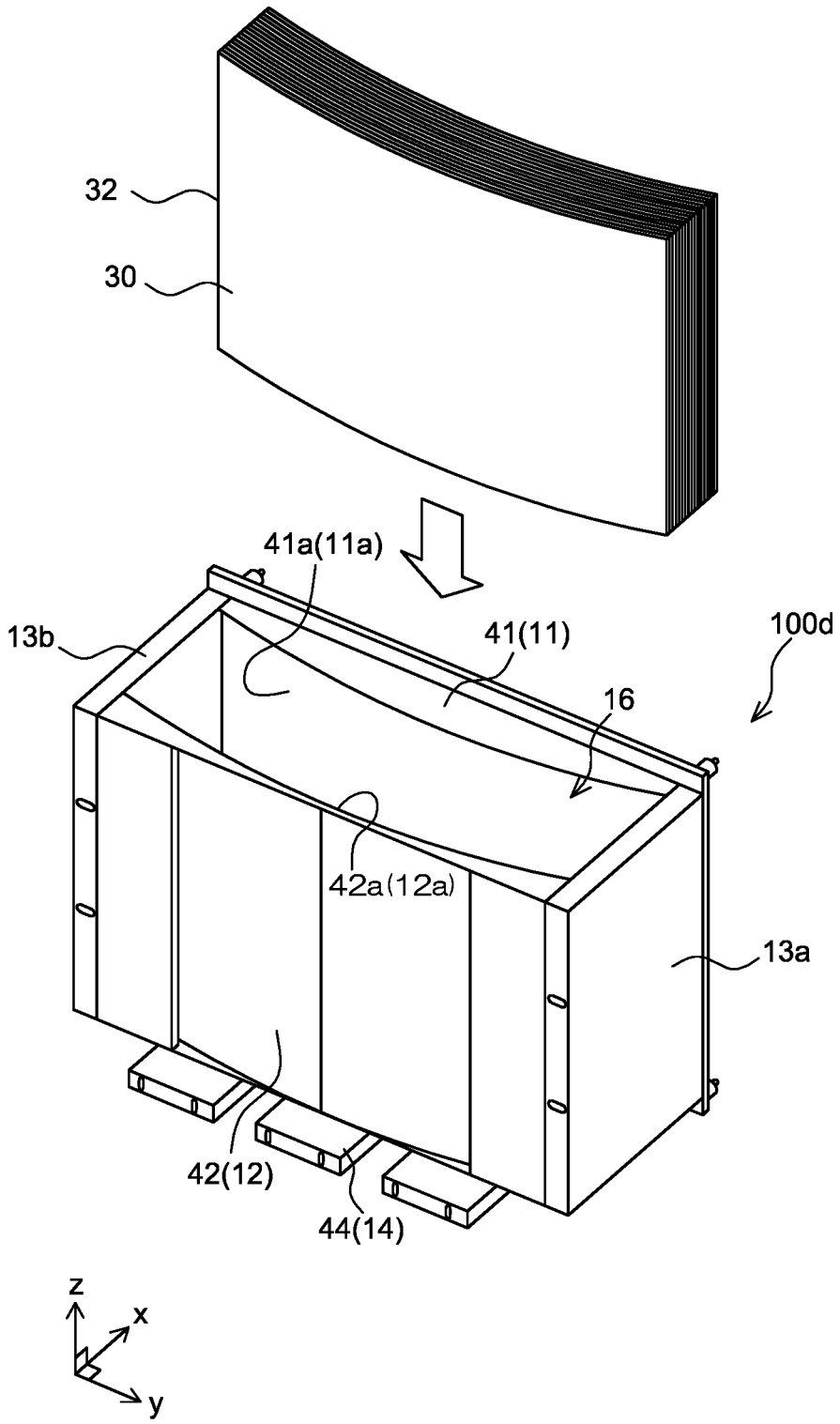
FIG. 7 is a principal perspective diagram of one example of a seasoning apparatus according to a fourth embodiment of the invention.

FIG. 7 is a principal perspective diagram of a seasoning apparatus 100*d* according to a fourth embodiment. Constituent elements which are the same as the seasoning apparatus 100*a* according to the first embodiment shown in FIG. 1 are labeled with the same reference numerals and items already described above are not explained further below.

In the present embodiment, a paper stack accommodating space 16 capable of accommodating a paper stack 32 in the vertical direction (the z direction in the drawings) is formed. To make a comparison with the seasoning apparatus 100*a* shown in FIG. 1, in the present embodiment, curved surfaces 41*a* and 42*a* are formed in a rear plate 41 (which corresponds to the paper stack loading table 11 in FIG. 1) and the front plate 42 (which corresponds to the ceiling plate 12 in FIG. 1), which face the paper stack 32 on the front and rear sides. The edges of the sheets of paper in the paper stack 32 abut against the paper stack loading table 44 (which corresponds to the front plate 14 in FIG. 1).

In FIG. 7, a ceiling plate (which corresponds to the rear plate 15 in FIG. 1) is not depicted, but a ceiling plate may be installed from the upper side in the vertical direction after the paper stack 32 has been introduced into the paper stack accommodating space 16. The air blowing devices (20 in FIG. 3) may be provided below the paper stack loading table 44 or may be provided above the ceiling plate. In the present embodiment, air is blown toward the edges of the sheets of paper in the paper stack 32.

Of the members (the paper stack accommodating space forming members) which form the paper stack accommodating space (16 in FIG. 1, FIG. 5 and FIG. 7), the paper opposing surfaces (11*a*, 12*a*, 41*a*, 42*a*) which face paper surfaces (the front surface or the rear surface of the paper stack 32) may include a flat portion.

Figure 8:
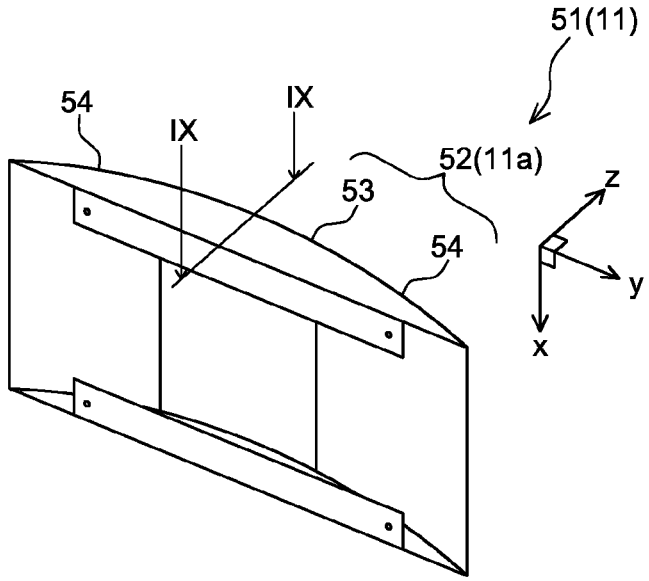
FIG. 8 is a perspective diagram showing one example of paper stack accommodating space forming members.
Figure 9:
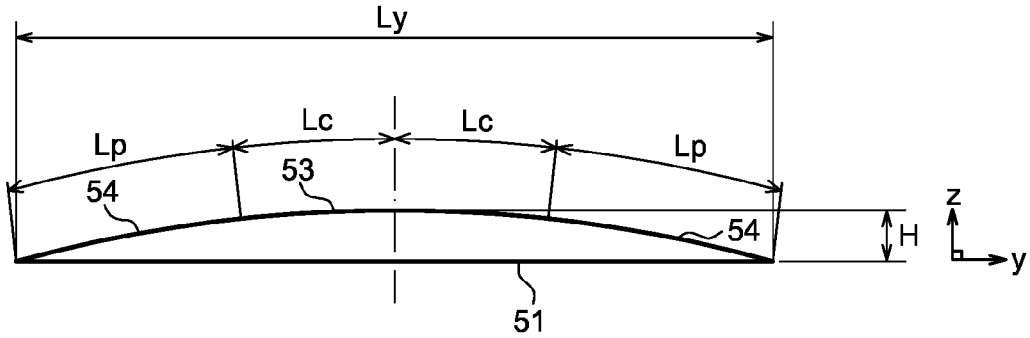
FIG. 9 is a cross-sectional view along IX-IX in FIG. 8.

For example, the paper stack accommodating space forming member 51 shown in the perspective diagram in FIG. 8 is used as the paper stack loading table 11 of the seasoning apparatus 100*a* in FIG. 1. FIG. 9 shows a cross-section along line IX-IX in FIG. 8. The paper opposing surface 52 of the accommodating space forming member 51 is constituted by a curved portion 53 and flat portions 54.

In the present specification, the paper opposing surface 52 which includes the flat portion 54*s* as well as the curved portion 53 is also called a "curved surface".

The respective dimensions in FIG. 9 are as follows.

Ly: 627.1±0.5 mm

Lc: 11.1°

Lp: 197.2 mm

H: 50.8 mm

In the paper opposing surface 52, the portion which faces the center of the paper stack 32 in the y direction in FIG. 9 is the curved portion 53, and the portions which face the ends of the paper stack 32 are the flat portions 54. By means of this paper opposing surface 52, the flow of air between the paper sheets is ensured, as well as ensuring that the curl in the end portions of the paper does not become large.

The paper stack accommodating space forming member 51 having a paper opposing surface 52 (curved surface) including a flat portion 54 of this kind can also be used as the ceiling plate 12 shown in FIG. 5 and as the rear plate 41 shown in FIG. 7. Moreover, the ceiling plate 12 in FIG. 1, the paper stack loading table 11 in FIG. 5 and the front plate 42 in FIG. 7 may also similarly use a paper stack accommodating space forming member having a paper opposing surface which includes a flat portion. In this case, the paper opposing surface (curved surface) is constituted by a concave-shaped curved portion and flat portions.

Next, a case where an air blowing apparatus relating to an embodiment of the present invention is incorporated into a printing apparatus will be described.

Figure 10:
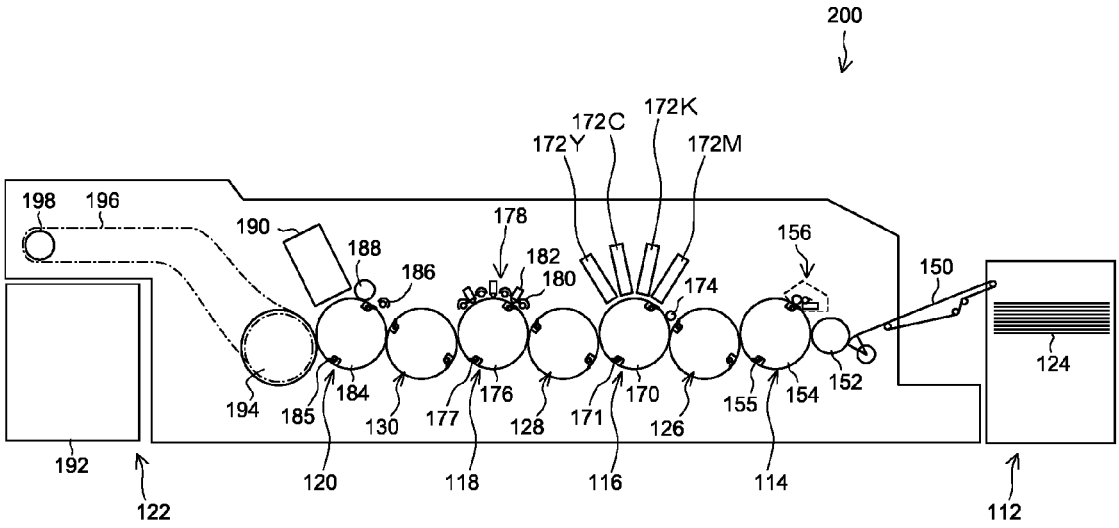
FIG. 10 is a schematic drawing of an inkjet printing apparatus including a seasoning apparatus.

FIG. 10 is a schematic drawing of an inkjet printing apparatus 200 including an air blowing apparatus relating to an embodiment of the present invention. The seasoning apparatus 100*c* shown in FIG. 6, for example, is disposed in the paper output section 122 shown in FIG. 10, which is described hereinafter. In the present example, air of the ambient temperature and humidity is blown toward the edges of a stack of paper 124 (paper stack) after printing.

The inkjet printing apparatus 200 is an inkjet printing apparatus using a pressure drum direct image formation method which forms a desired color image by ejecting droplets of inks of a plurality of colors from inkjet heads 172M, 172K, 172C and 172Y onto a recording medium 124 (also called "paper") held on a pressure drum (image formation drum 170) of an image formation unit 116. The inkjet printing apparatus 200 is a printing apparatus of an on-demand type employing a two-liquid reaction (aggregation) method in which an image is formed on a recording medium 124 by depositing a treatment liquid (here, an aggregating treatment liquid) on a recording medium 124 before ejecting droplets of ink, and causing the treatment liquid and ink liquid to react together.

The inkjet recording apparatus 100 includes a paper feed unit 112, a treatment liquid application unit 114, the image formation unit 116, a drying unit 118, a fixing unit 120, and a discharge unit 122, as main components.

The paper feed unit 112 has a mechanism for feeding a recording medium 124 to the treatment liquid application unit 114. The recording media 124, which each have a sheet shape, are stacked in the paper feed unit 112. The paper feed unit 112 is provided with a paper feed tray 150, and the recording medium 124 is fed, sheet by sheet, from the paper feed tray 150 to the treatment liquid application unit 114.

In the inkjet recording apparatus 100 according to the present embodiment, it is possible to use recording media 124 of different types and various sizes as the recording medium 124. A mode can be adopted in which the paper feed unit 112 has a plurality of paper trays (not illustrated) in which recording media of different types are respectively collected and stacked, and the paper that is fed to the paper feed tray 150 from the paper trays is automatically switched, and a mode can also be adopted in which an operator selects or exchanges the paper tray in accordance with requirements. In the present embodiment, cut sheets of paper are used as the recording media 124, but it is also possible to cut paper to a required size from a continuous roll of paper and then supply this cut paper.

The treatment liquid application unit 114 is a mechanism that applies the treatment liquid to the recording surface of the recording medium 124. The treatment liquid includes a coloring material aggregating agent that causes the aggregation of a coloring material (pigment in the present embodiment) included in the ink applied in the image formation unit 116, and the separation of the coloring material and the solvent of the ink is promoted when the treatment liquid is brought into contact with the ink The treatment liquid application unit 114 includes a paper transfer drum 152, a treatment liquid drum 154, and a treatment liquid application device 156. The treatment liquid drum 154 is a drum that holds and rotationally conveys the recording medium 124. Hook-shaped holding devices (grippers) 155 are provided on the outer circumferential surface of the treatment liquid drum 154, and the Hook-shaped holding devices (grippers) 155 each hold the leading end of the recording medium 124 by gripping the recording medium 124 between the hook of the gripper 155 and the circumferential surface of the treatment liquid drum 154. The treatment liquid drum 154 may have suction apertures on the outer circumferential surface thereof and be connected to a suction device for performing suction from the suction apertures. As a result, the recording medium 124 can be in close contact with and tightly held on the outer circumferential surface of the treatment liquid drum 154.

The treatment liquid application device 156 is provided on the outside of the treatment liquid drum 154 so as to opposite the outer circumferential surface thereof. The treatment liquid application device 156 includes: a treatment liquid container in which the treatment liquid is stored; an anilox roller a part of which is immersed in the treatment liquid stored in the treatment liquid container; and a rubber roller which is pressed against the anilox roller and the recording medium 124 that is held by the treatment liquid drum 154, so as to transfer the treatment liquid which has been metered, onto the recording medium 124. The treatment liquid application device 156 can apply the treatment liquid onto the recording medium 124 while metering the treatment liquid.

In the present embodiment, the application system using the roller is used; however, the present invention is not limited to this, and it is possible to employ a spraying method, an inkjet method, or other methods of various types.

The recording medium 124 onto which the treatment liquid has been applied in the treatment liquid application unit 114 is transferred from the treatment liquid drum 154 through the intermediate conveyance unit 126 to the image formation drum 170 of the image formation unit 116.

The image formation unit 116 includes the image formation drum 170, a paper pressing roller 174 and the inkjet heads 172M, 172K, 172C and 172Y. Similar to the treatment liquid drum 154, hook-shaped holding devices (grippers) 171 are provided on the outer circumferential surface of the image formation drum 170. The recording medium 124 held on the image formation drum 170 is conveyed in a state where the recording surface thereof faces outward, and inks are deposited on the recording surface by the inkjet heads 172M, 172K, 172C and 172Y.

The inkjet heads 172M, 172K, 172C and 172Y are recording heads (inkjet heads) of the inkjet system of the full line type that have a length corresponding to the maximum width of the image formation region in the recording medium 124. A nozzle row is formed on the ink ejection surface of the inkjet head. The nozzle row has a plurality of nozzles arranged therein for discharging ink over the entire width of the image recording region. Each of the inkjet heads 172M, 172K, 172C and 172Y is installed so as to extend in the direction perpendicular to the conveyance direction of the recording medium 124 (rotation direction of the image formation drum 170).

Droplets of corresponding colored ink are ejected from each of the inkjet heads 172M, 172K, 172C and 172Y toward the recording surface of the recording medium 124 being closely-contact with and held tightly on the image formation drum 170, and thereby the ink comes into contact with the treatment liquid that has been applied in advance on the recording surface by the treatment liquid application unit 114, the coloring material (pigment) dispersed in the ink is aggregated, and a coloring material aggregate is formed. Thus, the coloring material flow on the recording medium 124 is prevented, and an image is formed on the recording surface of the recording medium 124.

In the present embodiment, the CMYK standard color (four colors) configuration is described, but combinations of ink colors and numbers of colors are not limited to that of the present embodiment, and if necessary, light inks, dark inks, and special color inks may be added. For example, a configuration is possible in which inkjet heads are added that eject light inks such as light cyan and light magenta. The arrangement order of color heads is also not limited.

It is also possible to carry out image formation onto the recording medium 124 in a single pass by means of the image formation unit 116 composed as described above.

The recording medium 124 on which the image has been formed in the image formation unit 116 is transferred from the image formation drum 170 through an intermediate conveyance unit 128 to a drying drum 176 of the drying unit 118.

The drying unit 118 evaporates water included in the solvent that has been separated by the coloring material aggregation action. The drying unit includes the drying drum 176 and a solvent dryer 178.

Similar to the treatment liquid drum 154, hook-shaped holding devices (grippers) 177 are provided on the outer circumferential surface of the drying drum 176, and the leading end portion of the recording medium 124 can be held by the hook-shaped holding devices (grippers) 177.

The solvent dryer 178 is disposed in a position facing the outer circumferential surface of the drying drum 176, and includes a plurality of halogen heaters 180, and a plurality of warm-air blow-out nozzles 182 each of which is arranged between adjacent two of the halogen heaters 180.

By appropriately controlling the temperature and blowing rate of the warm air blown towards the recording medium 124 from each of the warm-air blow-out nozzles 182 and appropriately controlling the temperature of each of the halogen heaters 180, various drying conditions can be attained.

The surface temperature of the drying drum 176 is set to 50° C. or above. By heating the recording medium 124 from the rear surface thereof, drying is promoted and breaking of the image during fixing can be prevented. There are no particular restrictions on the upper limit of the surface temperature of the drying drum 176, but from the viewpoint of the safety of maintenance operations such as cleaning the ink adhering to the surface of the drying drum 176 (namely, preventing burns due to high temperature), desirably, the surface temperature of the drying drum 176 is not higher than 75° C. (and more desirably, not higher than 60° C.).

By holding the recording medium 124 on the outer circumferential surface of the drying drum 176 in such a manner that the recording surface thereof is facing outward (in other words, in a state where the recording surface of the recording medium 124 is curved in a convex shape), and performing the drying while conveying the recording medium in rotation, it is possible to prevent the occurrence of wrinkles and floating up of the recording medium 124, and therefore drying non-uniformities caused by these phenomena can be prevented reliably.

The recording medium 124 which has been subjected to the drying treatment in the drying unit 118 is transferred from the drying drum 176 through an intermediate conveyance unit 130 to a fixing drum 184 of the fixing unit 120.

The fixing unit 120 includes a fixing drum 184, a halogen heater 186, a fixing roller 188, and an inline sensor 190. Similar to the treatment liquid drum 154, hook-shaped holding devices (grippers) 185 are provided on the outer circumferential surface of the fixing drum 184, and the leading end portion of the recording medium 124 can be held by the hook-shaped holding devices (grippers) 185.

The recording medium 124 is conveyed by rotation of the fixing drum 184 in a state where the recording surface thereof faces outward, and the preheating by the halogen heater 186, the fixing treatment by the fixing roller 188 and the inspection by the inline sensor 190 are performed with respect to the recording surface.

The halogen heater 186 is controlled to a prescribed temperature (for example, 180° C.), by which the preheating is performed with respect to the recording medium 124.

The fixing roller 188 is a roller member which applies pressure and heat to the dried ink to melt and fix the self-dispersible polymer particles in the ink so as to transform the ink into the film. The fixing roller 188 is configured to apply pressure and heat the recording medium 124. More specifically, the fixing roller 188 is arranged so as to be made contact with and pressed against the fixing drum 184, and configures a nip roller in combination with the fixing drum 184. As a result, the recording medium 124 is squeezed between the fixing roller 188 and the fixing drum 184, nipped under a prescribed nip pressure (for example, 0.15 MPa), and subjected to fixing treatment.

Further, the fixing roller 188 is configured by a heating roller in which a halogen lamp is incorporated in a metal pipe, for example made from aluminum having good thermal conductivity, and the roller is controlled to a prescribed temperature (for example 60° C. to 80° C.). Where the recording medium 124 is heated with the heating roller, thermal energy not lower than a Tg temperature (glass transition temperature) of a latex included in the ink is applied and latex particles are melted. As a result, fixing is performed by penetration into the projections-recessions of the recording medium 124, the projections-recessions of the image surface are leveled out, and gloss is obtained.

The single fixing roller 188 is provided in the present example; however, it is possible that the fixing roller 188 has a configuration provided with a plurality of steps (it is possible to provide a plurality of fixing rollers at a plurality of stages), depending on the thickness of image layer and Tg characteristic of latex particles.

On the other hand, the inline sensor 190 is a measuring device which measures the check pattern, moisture amount, surface temperature, gloss, and the like, of the image fixed to the recording medium 124. A CCD sensor, or the like, can be used for the inline sensor 190.

With the fixing unit 120 of the above-described configuration, the latex particles located within a thin image layer formed in the drying unit 118 are melted by application of pressure and heat by the fixing roller 188. Thus, the latex particles can be reliably fixed to the recording medium 124. The surface temperature of the fixing drum 184 is set to 50° C. or above. Drying is promoted by heating the recording medium 124 held on the outer circumferential surface of the fixing drum 184 from the rear surface, and therefore breaking of the image during fixing can be prevented, and furthermore, the strength of the image can be increased by the effects of the increased temperature of the image.

If an ink containing an active light-curable resin such as a UV-curable resin is used instead of an ink containing thermoplastic resin particles, a device which radiates the active light, such as a UV lamp or a UV laser diode (Laser Diode) array, is provided instead of the fixing roller 188 for heat fixing.

The paper output unit 122 is provided after the fixing unit 120. The paper output unit 122 includes the output tray 192. Between the output tray 192 and the fixing drum 184 of the fixing unit 120, transfer drums 194 and 195 and a conveying belt 196 are provided. The conveying belt 196 is wound around tension rollers 197 and 198. The recording medium 124 that has passed through the fixing drum 184 is fed by the transfer drum 194 and 195 onto the conveying belt 196 and transferred onto the output tray 192 from the conveying belt 196. The configuration and operation of the output tray 192 will be described later.

Although not shown in FIG. 10, the inkjet recording apparatus 100 in the present embodiment also includes, in addition to the above-described units: an ink storing and loading unit for supplying the inks to the inkjet heads 172M, 172K, 172C and 172Y; a treatment liquid supply unit for supplying the treatment liquid to the treatment liquid application unit 114; a head maintenance unit for cleaning the inkjet heads 172M, 172K, 172C and 172Y (e.g., wiping of the nozzle surface, purging, and suction for the nozzles); position determination sensors for determining the position of the recording medium 124 in the medium conveyance path; and temperature sensors for measuring temperature in the respective parts of the inkjet recording apparatus.

Figure 11:
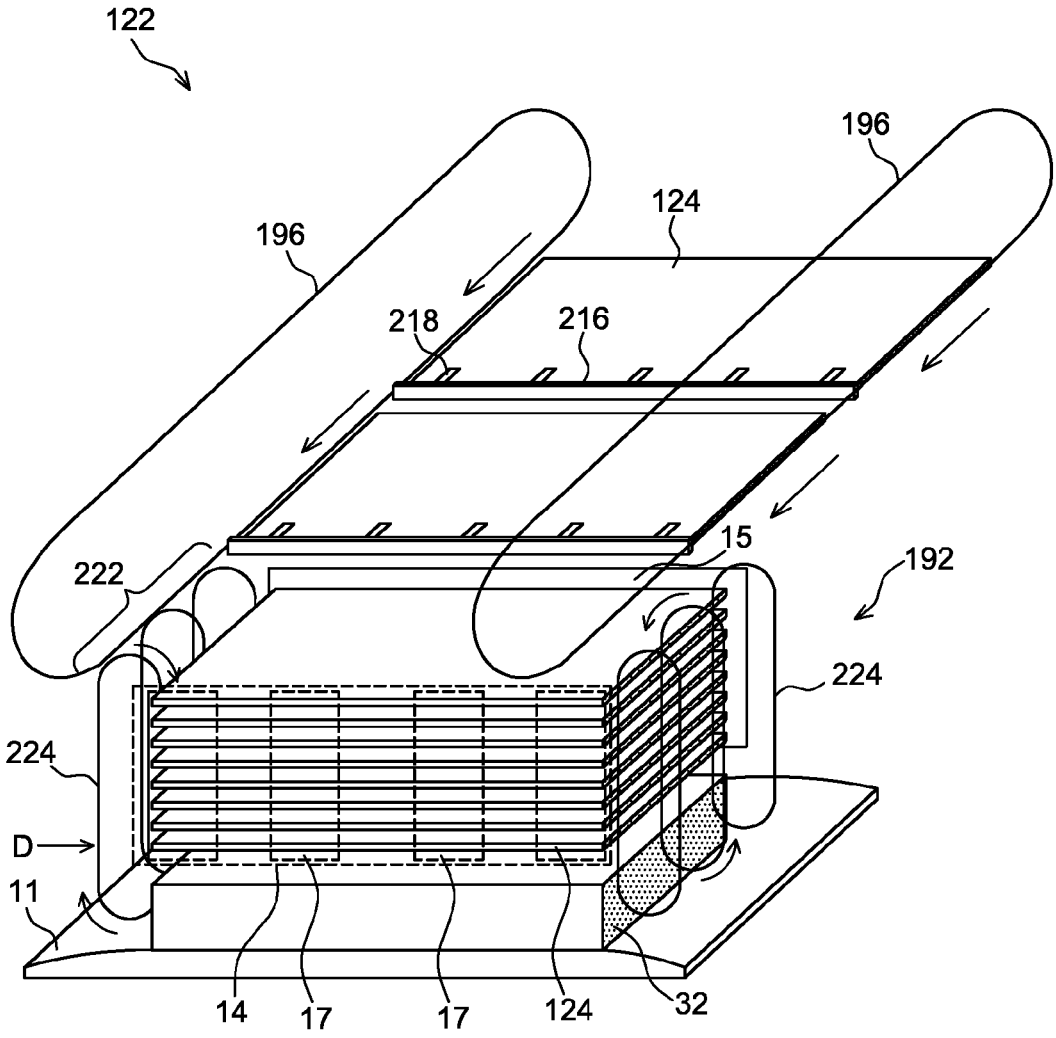
FIG. 11 is a perspective diagram showing one example of a paper stack loading mechanism.

FIG. 11 is a perspective diagram showing one example of a paper stack loading mechanism in the paper output section 122. The thickness of the paper 124 is depicted larger than the actual thickness. As shown in FIG. 11, a plurality of bars 216 are installed on conveyance chains 196. These bars 216 are spaced apart at intervals which are longer than one edge (here, the shorter edge) of the paper 124. A plurality of grippers 218 (in FIG. 11, five grippers are shown as an example) are provided on each bar 216. The paper 124 after printing is held, one sheet at a time, by the grippers 218 of each of the bars 216, and is conveyed above the paper output unit 192 by the rotation of the conveyance chains 196. The trailing edge portion of the paper 124 is in an unrestricted (free) state, but since the conveyance speed of the conveyance chains 196 is fast, then each sheet of paper 124 is conveyed in a substantially horizontal state.

The paper output unit 192 includes a paper conveyance mechanism 222 which receives sheets 124 released from the grippers 218, and conveys the sheets 124 to the paper stack loading table 11 situated in a lower position while holding the sheets in a state where the sheets are separated one by one. The conveyance chains 196 convey the sheet 124 to a prescribed transfer position and release the holding of the grippers 218 at this transfer position. A plurality of hooks having a mechanism capable of holding and releasing the paper 124 are provided on each of endless traveling bodies 224 which constitute the paper conveyance mechanism 222. The sheet 124 is held by being gripped between the hooks. The endless traveling bodies 224 grip the sheet 124 which has been released from the grippers 218 of the conveyance chains 196, at a prescribed reception position; move downwards while gripping the sheet 124 (i.e. in a state where the sheet 124 is held), so that the paper 124 is moved downwards due to the movement of the endless traveling bodies 224; and then release the sheet 124 at a prescribed release position (the position indicated by reference symbol D).

In the present embodiment, it is also possible to provide a plurality of air blowing devices on either side of the conveyance path, on the outer perimeter side surface of the conveyance path of the paper conveyance mechanism 222. A front plate 14 is erected on a surface where air blowing devices are provided (a surface facing a long edge of the paper 124), and air blowing ports 17 (opening sections) are formed in the front plate 14. The air flow from the air blowing devices is introduced via these air blowing ports 17. If the seasoning apparatus 100*c* in FIG. 6 is used, the endless traveling bodies 224 are provided on the side plates (13*a* and 13*b* in FIG. 6).

In FIG. 11, the ceiling plate (12 in FIG. 6) is omitted, but it is possible to adopt various modes, such as a mode in which a ceiling plate 12 is provided on the upper side in the vertical direction of the conveyance path of the paper conveyance mechanism 222 and a mode in which a ceiling plate 12 descends toward the upper surface of the paper stack 32 while conveyance is halted. It is also possible to omit the ceiling plate 12 in actual practice, by using the paper 124 during conveyance rather than the ceiling plate 12.

Furthermore, a case has been described where a paper stack 32 is loaded on the paper stack loading table 11 by causing the paper 124 to descend from above in the vertical direction, but the invention is not limited in particular to cases such as this. For instance, it is also possible to introduce paper 124 onto the paper stack loading table 11 from a horizontal direction (or an oblique direction).

Here, an example is described, with reference to FIG. 10, in which an air blowing apparatus relating to an embodiment of the present invention is incorporated into an inkjet printing apparatus, but needless to say, the air blowing apparatus may also be incorporated into another printing apparatus. For example, it may be incorporated into an electrophotographic type of printing apparatus.

There follows a description of an example where air blowing apparatuses are superposed in a plurality of tiers.

Figure 12:
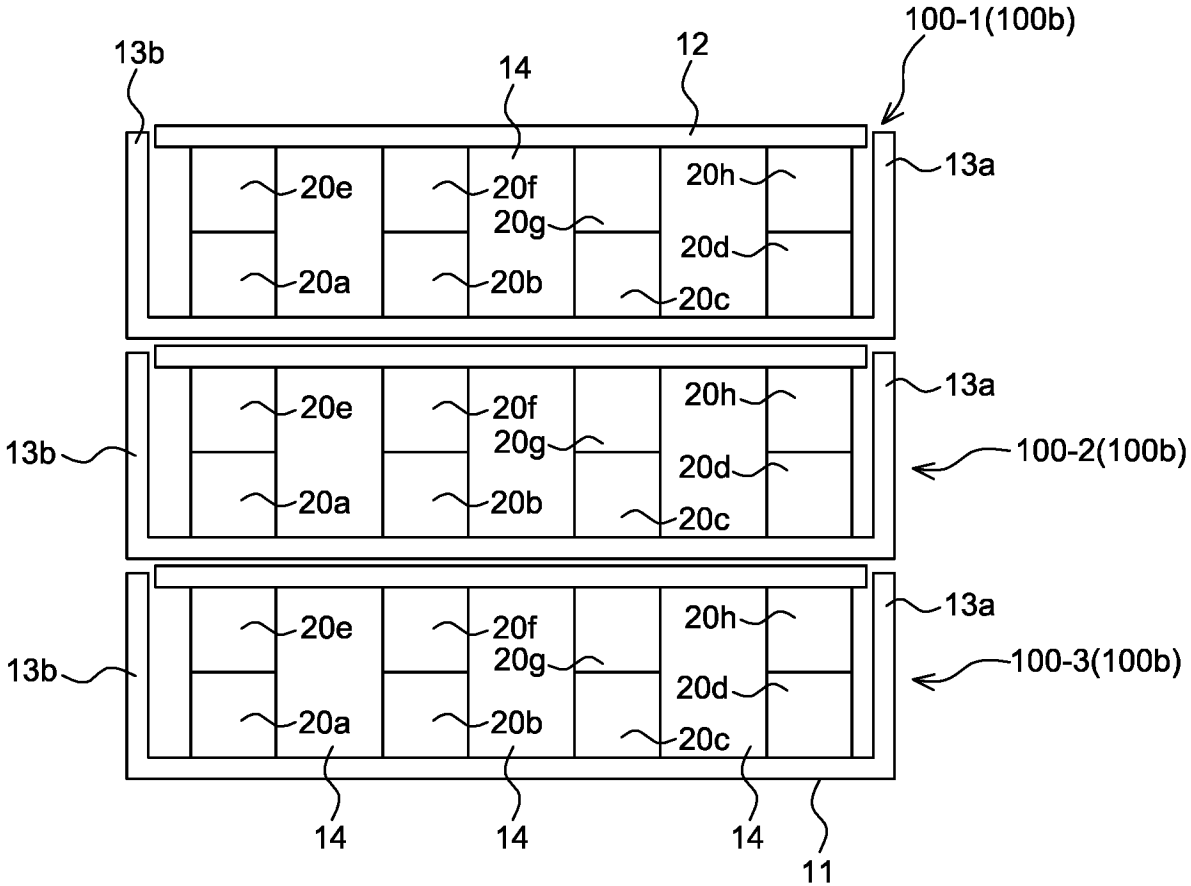
FIG. 12 is an illustrative diagram for describing a case where air blowing apparatuses are mutually superposed in a plurality of tiers.

FIG. 12 shows a case where seasoning apparatuses 100*b* in FIG. 5 are mutually superposed in three tiers. In FIG. 12, a portion of the end face of the paper stack loading table 11 and the ceiling plate 12 is covered with the front plate 14 and the air blowing devices 20, and therefore the curved surfaces 11*a* and 12*a* of the paper stack loading table 11 and the ceiling plate 12 are concealed and are not visible. However, in practice, the curved surfaces 11*a* and 12*a* are each formed in a curved shape as shown in FIG. 5.

Above, an embodiment of the present invention is described in relation to an example of a seasoning apparatus which blows air of the ambient temperature and humidity onto a stack of paper, but the present invention is not limited in particular to cases of this kind. The present invention can also be applied to cases where air is blown at a temperature higher or lower than the ambient temperature, or at a humidity higher or lower than the ambient humidity. Nevertheless, desirably, air is blown at a uniform temperature and humidity so as to achieve a uniform temperature and humidity between the sheets of paper and within the sheets of paper.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An air blowing apparatus comprising:

a paper stack accommodating section which forms a paper stack accommodating space for accommodating a stack of paper; and an air blowing device which blows air toward an edge of each sheet of paper of the stack of paper accommodated in the paper stack accommodating space, wherein the paper stack accommodating section includes a curved surface which faces a paper surface of the stack of paper, and the curved surface extends in an air blowing direction of the air blowing device and has a curvature in a direction perpendicular to the air blowing direction of the air blowing device, the paper stack accommodating section includes a plurality of curved surfaces which respectively face paper surfaces of the stack of paper and have a same direction of curve, the paper stack accommodating space being sandwiched between the plurality of curved surfaces, and the plurality of curved surfaces have mutually different finite curvatures.

2. The air blowing apparatus as defined in claim 1, wherein the paper stack accommodating section forms the paper stack accommodating space in which the stack of paper can be accommodated in the vertical direction.

3. The air blowing apparatus as defined in claim 1, wherein the paper stack accommodating section is capable of adjusting a size of the paper stack accommodating space in accordance with a paper size of the stack of paper.

4. The air blowing apparatus as defined in claim 1, wherein the paper stack accommodating section has a ridge portion that connects with the curved surface, is situated on a paper input side, and is formed in a chamfered shape.

5. The air blowing apparatus as defined in claim 1, wherein the curvature of the curved surface is substantially same in the air blowing direction.

6. The air blowing apparatus as defined in claim 1, wherein:

the paper stack accommodating section includes a paper stack loading table on which the stack of paper is mounted, and a ceiling plate disposed to face the paper stack loading table, each of the paper stack loading table and the ceiling plate having the curved surface; and the paper stack accommodating space is formed as a space sandwiched between the curved surface of the paper stack loading table and the curved surface of the ceiling plate.

7. The air blowing apparatus as defined in claim 6, wherein the curved surface of the paper stack loading table and curved surface of the ceiling plate are both formed to curve downward in a vertical direction.

8. An air blowing method comprising the steps of:

accommodating a stack of paper in a paper stack accommodating space sandwiched between a first surface and a second surface opposing the first surface, the first surface extending in a first direction and having a curvature in a second direction perpendicular to the first direction; and blowing air toward an edge of each sheet of paper of the stack of paper in the first direction, by an air blowing device, wherein the first surface and the second surface have mutually different finite curvatures.

9. An air blowing apparatus comprising:

a paper stack accommodating section which forms a paper stack accommodating space for accommodating a stack of paper; and an air blowing device which blows air toward an edge of each sheet of paper of the stack of paper accommodated in the paper stack accommodating space, wherein the paper stack accommodating section includes a curved surface which faces a paper surface of the stack of paper, and the curved surface extends in an air blowing direction of the air blowing device and has a curvature in a direction perpendicular to the air blowing direction of the air blowing device, the paper stack accommodating section includes a plurality of curved surfaces which respectively face paper surfaces of the stack of paper and have a same direction of curve, the paper stack accommodating space being sandwiched between the plurality of curved surfaces, and the plurality of curved surfaces have substantially same finite curvatures.

10. An air blowing method comprising the steps of:

accommodating a stack of paper in a paper stack accommodating space sandwiched between a first surface and a second surface opposing the first surface, the first surface extending in a first direction and having a curvature in a second direction perpendicular to the first direction; and blowing air toward an edge of each sheet of paper of the stack of paper in the first direction, by an air blowing device, wherein the first surface and the second surface have substantially same finite curvatures.

* * * * *